US006588501B1

(12) United States Patent
Boyadjieff

(10) Patent No.: US 6,588,501 B1
(45) Date of Patent: Jul. 8, 2003

(54) METHOD AND APPARATUS TO REDUCE HYDROSTATIC PRESSURE IN SUB SEA RISERS USING BUOYANT SPHERES

(75) Inventor: George Boyadjieff, Villa Park, CA (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 10/259,550

(22) Filed: Sep. 27, 2002

(51) Int. Cl.[7] ..... E21B 21/01

(52) U.S. Cl. ..... 166/75.15; 166/367; 175/205; 175/206

(58) Field of Search ..... 166/311, 367, 166/75.15, 310; 175/205, 206

(56) References Cited

U.S. PATENT DOCUMENTS

| | | | | |
|---|---|---|---|---|
| 1,032,132 | A | | 7/1912 | Gormley |
| 2,630,903 | A | | 3/1953 | Currivan |
| 2,827,998 | A | | 3/1958 | Breeback |
| 2,961,045 | A | | 11/1960 | Stogner et al. |
| 2,981,335 | A | | 4/1961 | Bucy et al. |
| 3,028,996 | A | | 4/1962 | Ellett |
| 3,039,531 | A | | 6/1962 | Scott |
| 3,403,729 | A | | 10/1968 | Hickey |
| 3,637,021 | A | | 1/1972 | Hutchison et al. |
| 4,154,373 | A | | 5/1979 | Schmidt |
| 4,185,703 | A | | 1/1980 | Guerber |
| 4,273,235 | A | | 6/1981 | Rustand |
| 4,310,058 | A | | 1/1982 | Bourgoyne, Jr. |
| 4,369,845 | A | | 1/1983 | Henson et al. |
| 4,421,167 | A | | 12/1983 | Erbstoesser et al. |
| 5,200,081 | A | | 4/1993 | Stuth |
| 5,202,027 | A | | 4/1993 | Stuth |
| 5,301,792 | A | | 4/1994 | Spatafora et al. |
| 5,387,335 | A | | 2/1995 | Iwai et al. |
| 5,709,266 | A | * | 1/1998 | Kruse ..... 166/75.15 |
| 5,934,377 | A | | 8/1999 | Savage |
| 5,945,005 | A | | 8/1999 | Junius et al. |
| 6,004,074 | A | * | 12/1999 | Shanks, II ..... 405/195.1 |
| 6,390,189 | B1 | * | 5/2002 | Tienari et al. ..... 166/75.15 |
| 2002/0011338 | A1 | * | 1/2002 | Maurer et al. ..... 166/372 |

* cited by examiner

*Primary Examiner*—David Bagnell
*Assistant Examiner*—Robert D. Jones
(74) *Attorney, Agent, or Firm*—Christie, Parker & Hale, LLP

(57) ABSTRACT

A pumping system for injecting buoyant spheres into an oil or gas well having a feeder containing a plurality of buoyant spheres; and a sphere pump in proximity to the feeder, having first and second rotatable wheels, wherein the first wheel has a plurality of notches and the second wheel has a corresponding plurality of notches, such that during rotation of the wheels the first and second wheel notches temporarily combine to form a plurality of pockets, wherein each pocket receives then ejects one of the plurality of buoyant spheres from the feeder during rotation of the first and second wheels.

36 Claims, 4 Drawing Sheets

14
20
52
58
60
54
56
12
22
12
26
10
28
24
42
16
47
46
17
51
48
18
50
19

METHOD AND APPARATUS TO REDUCE HYDROSTATIC PRESSURE IN SUB SEA RISERS USING BUOYANT SPHERES

FIELD OF THE INVENTION

The present invention relates generally to sub-sea oil and gas wells. More particularly, the present invention relates to a pump for reducing the density of a drilling fluid in sub-sea oil and gas wells.

BACKGROUND OF THE INVENTION

When drilling sub-sea oil and gas wells, typically a hollow cylindrical tube (commonly referred to as a riser) is inserted into the ocean from the ocean surface to the ocean floor. A string of drill pipe as well as drilling fluid (commonly referred to as drilling mud, or mud) may be placed within the hollow portion of the cylindrical tube. This column of fluid is commonly referred to as the mud column. Generally, the density of the drilling mud is up to 50% greater than the density of the seawater.

At deep water levels, the pressure exerted by the drilling mud on the ocean floor is significantly greater than the pressure exerted by the seawater on the ocean floor. This higher drilling mud pressure can fracture the well bore extending below the ocean surface. If this happens, the drilling has to stop until the well is sealed, typically by use of casings. For deepwater wells, it is not unusual to run out of casing strings because each subsequent casing string has to be run inside the previous casing string.

Various methods have been produced to solve this problem, including installing pumps on the ocean floor to pump the drilling mud to the ocean surface, thereby reducing its apparent pressure. Another method involves decreasing the drilling mud density by injecting lighter materials into the mud column thereby creating a mixture that has a lighter density than the drilling mud. Buoyant spheres have been advantageously used for this method because they can be easily manufactured from high strength, low density materials that can withstand high pressures while also decreasing the drilling mud density.

In order to be effective, the spheres need to be pumped down to the a lower end of the mud column, near the drilling surface on the ocean floor, and injected into the mud column. However, conventional pumps cannot supply the amount of force necessary to pump relatively large spheres to the ocean floor. As a result, small spheres must be used. However, small spheres are not as efficient at decreasing the drilling mud density as large spheres are. In addition, once the spheres return to the upper end of the mud column, they must be separated from the drilling mud, so that both the drilling mud and the spheres may be reused. It is much easier to separate large spheres from the drilling mud than it is to separate small spheres from the drilling mud.

SUMMARY OF THE INVENTION

An exemplary embodiment of the present invention includes a pumping system for injecting buoyant spheres into an oil or gas well comprising: a feeder containing a plurality of buoyant spheres; and a sphere pump in proximity to the feeder, having first and second rotatable wheels, wherein the first wheel has a plurality of notches and the second wheel has a corresponding plurality of notches, such that during rotation of the wheels the first and second wheel notches temporarily combine to form a plurality of pockets, wherein each pocket receives then ejects one of the plurality of buoyant spheres from the feeder during rotation of the first and second wheels.

In another embodiment of the present invention, the pumping system for injecting buoyant spheres into an oil or gas well further comprises a conveyance pipe having proximal and distal ends, wherein its proximal end is connected to an outlet of the sphere pump and its distal end is connected to a lower end of an oil or gas well; and a second pump in fluid communication with the conveyance pipe.

A further embodiment of the present invention includes a pumping system for injecting buoyant spheres into an oil or gas well comprises a feeder containing a plurality of buoyant spheres; a positive displacement sphere pump in proximity to the feeder, having first and second counter rotating wheels, wherein the first wheel has a plurality of generally hemispherical notches and the second wheel has a corresponding plurality of generally hemispherical notches, such that during rotation of the wheels, the first and second wheel notches temporarily combine to form a plurality of generally spherical pockets, wherein each pocket receives then ejects one of the plurality of buoyant spheres from the feeder during rotation of the first and second wheels; a conveyance pipe having proximal and distal ends, wherein its proximal end is connected to an outlet of the sphere pump and its distal end is connected to a lower end of an oil or gas well; and a second pump in fluid communication with the conveyance pipe.

Another embodiment of the present invention includes a method of reducing a density of a drilling fluid in an oil or gas well comprising: conveying a plurality of buoyant spheres to a feeder; providing a sphere pump in proximity to the feeder, which applies a first force to the plurality of buoyant spheres, wherein the sphere pump is connected to a proximal end of a conveyance pipe and wherein a distal end of the conveyance pipe is connected to a lower end of a portion of an oil or gas well that is adjacent to the drilling fluid; providing a second pump in fluid communication with the proximal end of the conveyance pipe, which applies a second force to the plurality of buoyant spheres, wherein the first and second forces cause the buoyant spheres to be injected into the drilling fluid to decrease the density of the drilling fluid.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
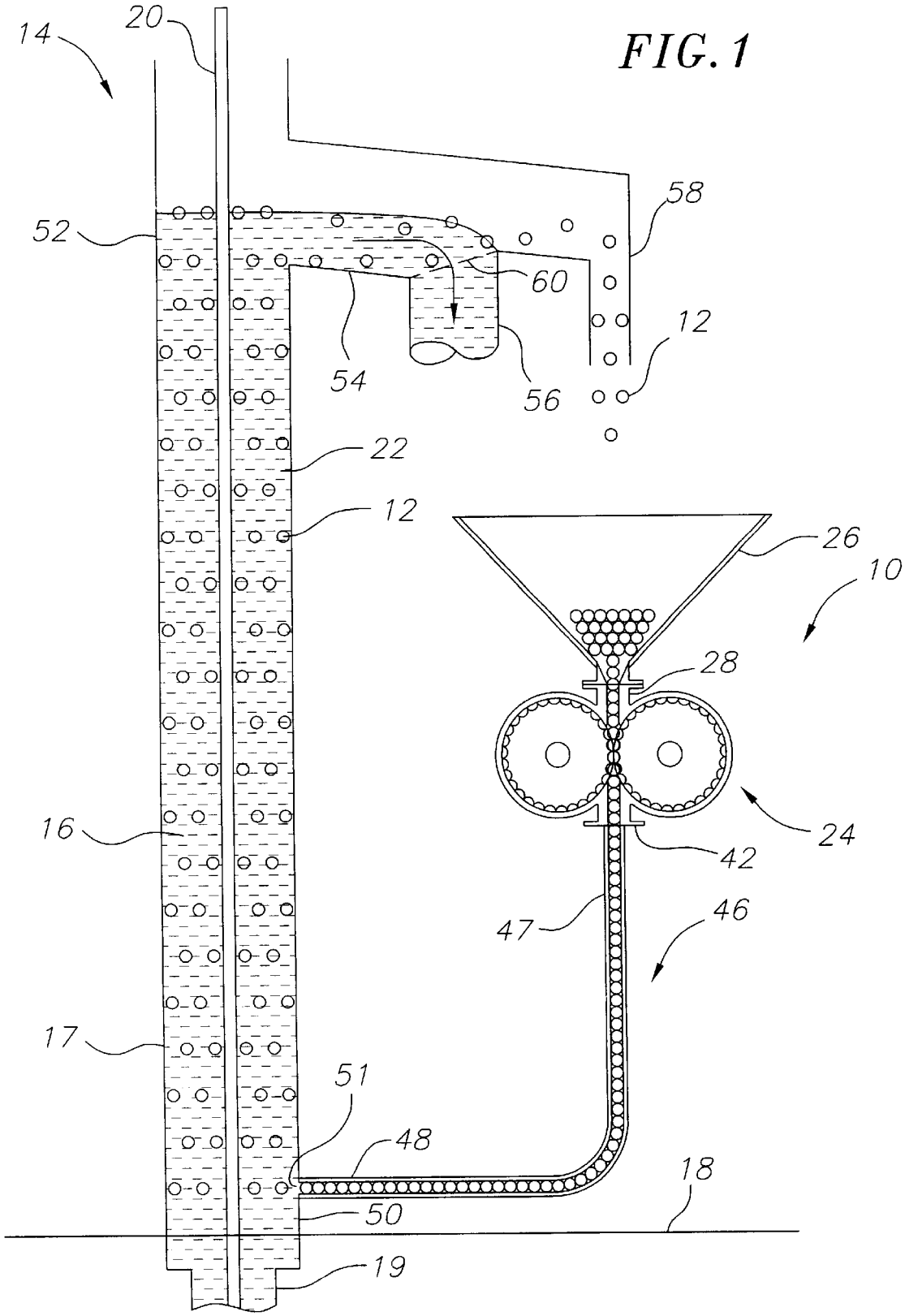
FIG. 1 is a schematic of a pumping system according to the present invention.

As shown in FIG. 1, the invention is directed to a pumping system 10 for injecting buoyant spheres 12 into an oil or gas well 14. In one embodiment, the pumping system 10 is used in a sub-sea oil or gas well 14. When drilling sub-sea oil and gas wells 14, typically a hollow cylindrical column (commonly referred to as a riser 17) is inserted into the ocean, such that the riser 17 extends from a drilling surface on the ocean floor 18 to a position near or above the ocean surface. A string of drill pipe 20 as well as drilling fluid (commonly referred to as drilling mud 22, or mud) may be placed within the hollow portion of the riser 17. This fluid column is commonly referred to as a mud column 16.

As described above, it is often desirable to decrease the density of the drilling mud 22 to decrease the likelihood that the drilling mud 22 will fracture the well bore 19. The pumping system 10 of the current invention accomplishes this by pumping buoyant spheres 12, having a density at least less than the density of the drilling mud 22, into the mud column 16.

The buoyant spheres 12 may be made of any suitable material that can withstand a pressure in the range of about 500 psi to about 5000 psi and having a density at least less than the density of the drilling mud 22. For example, the drilling mud 22 typically has a density in the range of about 9 ppg to about 16 ppg and each buoyant sphere 12 of the current invention typically has a density in the range of about 3 ppg to about 5 ppg. In one embodiment the buoyant spheres 12 are comprised of a porous plastic material, such as polystyrene. In another embodiment, the buoyant spheres 12 are comprised of a hollow metal material, such as steel.

In the depicted embodiment of FIG. 1, the buoyant spheres 12 are fed into a sphere pump 24, for example by a feeder 26. The feeder 26 may be a conically shaped vibratory feeder common to many bulk feeding systems. The feeder ensures that the buoyant spheres 12 properly enter the sphere pump 24.

Figure 2A:
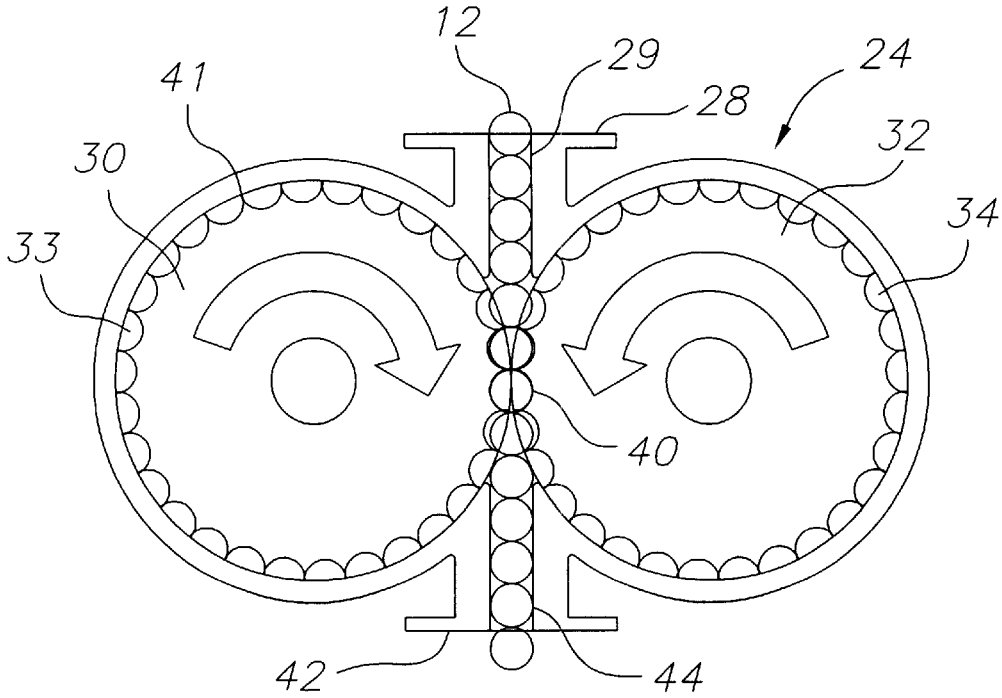
FIG. 2A is a schematic of a sphere pump of the pumping system of FIG. 1.

As shown in FIG. 2A, the sphere pump 24 may comprise an inlet 28 disposed adjacent to the feeder 26 and having a channel 29 with a diameter that is slightly larger than the diameter of the buoyant spheres 12. The inlet channel 29 feeds the buoyant spheres 12 into a wheel portion of the sphere pump 24. The wheel portion comprises a first wheel 30 and a second wheel 32. Each wheel 30 and 32 comprises a plurality of notches, i.e., the first wheel 30 comprises a plurality of notches 33 and the second wheel 32 comprises a plurality of notches 34.

Figure 2B:
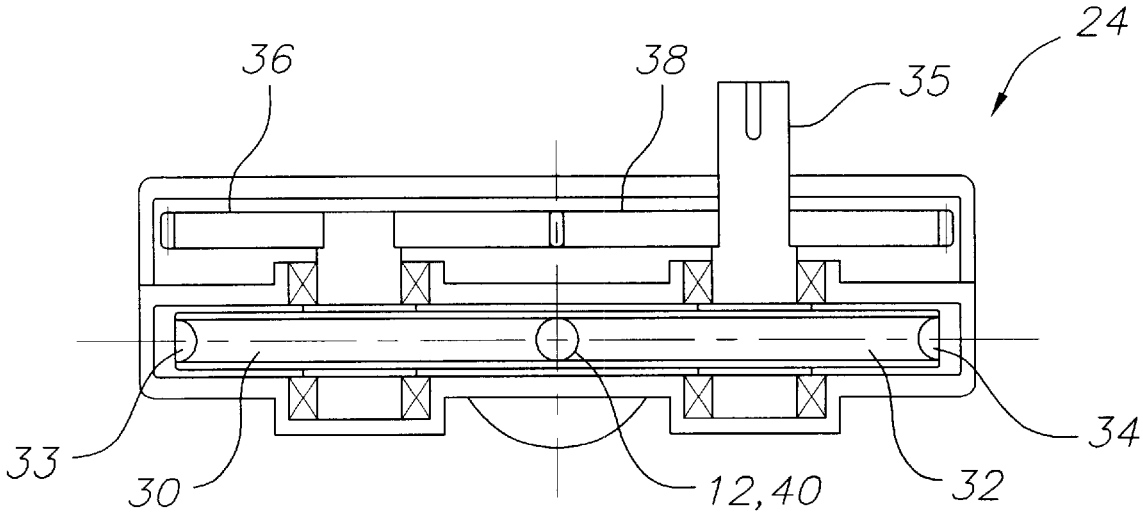
FIG. 2B is a top view of a sphere pump of FIG. 2A.

As shown in FIG. 2B, the sphere pump 24 may comprise a drive shaft 35 and each wheel 30 and 32 may comprise a matching or synchronizing gear, such as a first synchronizing gear 36 and a second synchronizing gear 38. In the depicted embodiment, the drive shaft 35 is connected to the second synchronizing gear 38, and the second synchronizing gear 38 meshes with the first synchronizing gear 36, such that the drive shaft 35 drives each gear 36 and 38 and therefore each wheel 30 and 32. Preferably, the synchronizing gears 36 and 38 may be oriented such that they counter rotate with respect to each other, which in turn causes the wheels 30 and 32 to counter rotate with respect to each other.

In addition, the synchronizing gears 36 and 38 may contain meshing teeth of a number, size, and orientation to ensure that each notch in the plurality of first wheel notches 33 is aligned with a corresponding notch in the plurality of second wheel notches 34, such that during rotation of the wheels 30 and 32, each aligned pair of notches forms a pocket, and the plurality of notches 33 and 34 form a plurality of pockets 40.

In one embodiment, each notch of the plurality of notches 33 and 34 is generally hemispherical, such that during rotation of the wheels 30 and 32 each aligned pair of notches forms a generally spherical pocket. In such an embodiment, the spherical pocket may have a diameter that is substantially equal to the diameter of the buoyant spheres 12. Preferably, the buoyant spheres 12 are relatively large in diameter. For instance, the buoyant spheres 12 may have a diameter in the range of about 1 inch to about 3 inches. Although other sphere diameters may be used with the pumping system 10 of the present invention, large buoyant spheres provide a number of advantages over relatively small buoyant sphere. For example, once the buoyant spheres 12 return to an upper end of the mud column 16, they are separated from the mud 22 before reuse of both the mud 22 and the buoyant spheres 12. It is easier to separate the mud 22 from large spheres than it is to separate the mud 22 from small spheres. In addition, small spheres are not as efficient at decreasing the density of the mud 22 as large spheres are.

In one embodiment, the outer diameter of each wheel 30 and 32 is approximately ten times larger in diameter than the diameters of the buoyant spheres 12 and the plurality of notches 33 and 34 are formed in and equally spaced about the outer diameters of the wheels 30 and 32. For example, the plurality of notches 33 and 34 may be formed in and spaced about the outer diameters of the wheels 30 and 32 such that a minimal spacing 41 exists between adjacent notches on each wheel 30 and 32. This creates a positive displacement pump, meaning that the buoyant spheres 12 pass through the pump in direct proportion to the speed of the drive shaft 35.

The sphere pump 24 may comprise an outlet 42, having a channel 44 with a diameter that is slightly larger than the diameter of the buoyant spheres 12. As depicted in FIG. 1, the pumping system 10 may also comprise a conveyance pipe 46 having a proximal end 47 and a distal end 48. The conveyance pipe 46 may be connected at its proximal end 47 to the sphere pump outlet 42 and at its distal end 48 to a lower end 50 of the mud column 16.

The conveyance pipe 46 guides the buoyant spheres 12 from the sphere pump 24 to the lower end 50 of the mud column 16. In the depicted embodiment, the conveyance pipe 46 is a hollow cylindrical pipe having an inner diameter that is slightly larger than the diameter of the buoyant spheres 12.

In one embodiment of the invention, during operation of the pumping system 10, the buoyant spheres 12 are feed from the feeder 26 to the sphere pump inlet 28. The sphere pump inlet 28 is adjacent to the wheels 30 and 32, which comprise the plurality of notches 33 and 34, respectively. The plurality of first wheel notches 33, are aligned with the plurality of second wheel notches 34, to form the plurality of pockets 40, wherein each pocket receives one of the plurality of buoyant spheres 12 per revolution of the wheels 30 and 32. Rotation of the wheels 30 and 32 causes each pocket to apply a pumping force to each buoyant sphere 12 it receives, thus ejecting the buoyant sphere 12 from the pocket, into the sphere pump 24 outlet 42 and into the conveyance pipe 46. The conveyance pipe 46 guides the buoyant spheres 12 from the sphere pump 24 to the lower end 50 of the mud column 16. The buoyant spheres 12 enter the mud column 16, for example through mud column opening 51 and mix with the drilling mud 22 to decrease the density of the drilling mud 22 in the mud column 16.

Once in the mud column 16, the buoyant spheres 12 float, within the drilling mud 22, from the lower end 50 of the mud column 16 to an upper end 52 of the mud column 16. The upper end 52 of the mud column 16 may comprise a mud flow return line 54, having a mud channel 56 and a sphere channel 58. The mud flow return line 54 guides the drilling mud 22 and the buoyant spheres 12 over the mud channel 56. The mud channel 56 may comprise a screen 60 having openings that are at least smaller than the diameter of the buoyant spheres 12. The mud channel screen 60 allows the drilling mud 22, as well as drill bit shavings and/or other drilling debris, to enter the mud channel 56 while preventing the buoyant spheres 12 from entering the mud channel 56. The mud channel 56 guides the drilling mud 22, as well as any other material that passes the mud channel screen 60 to a mud cleaning system (not shown), which "cleans" the mud 22 by removing drill bit shavings and/or other drilling debris from the drilling mud 22. The "cleaned" drilling mud 22 is then recirculated into the mud column 16.

Since the buoyant spheres 12 cannot pass through the mud channel screen 60, the mud flow return line 54 guides the buoyant spheres 12 past the mud channel screen 60, to the sphere channel 58. The sphere channel 58 guides the buoyant spheres 12 into the feeder 26. The feeder 26 guides the buoyant spheres 12 into the sphere pump 24 which recirculates the buoyant spheres 12 into the mud column 16 in the same manner as described above.

Figures 3A, 3B:
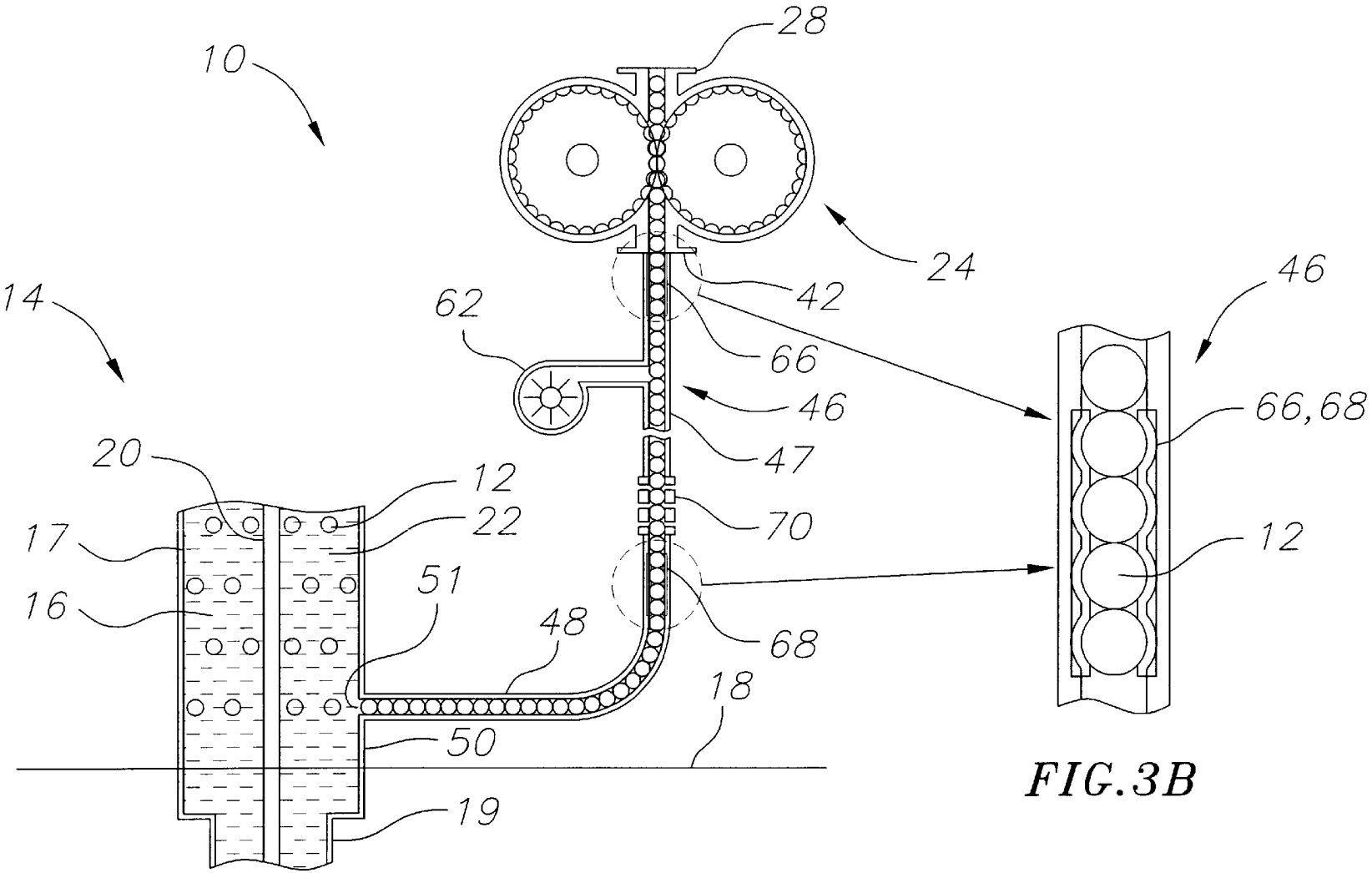
FIG. 3 is schematic of the pumping system of FIG. 1, with the addition of a fluid displacement pump.
Figure 4:
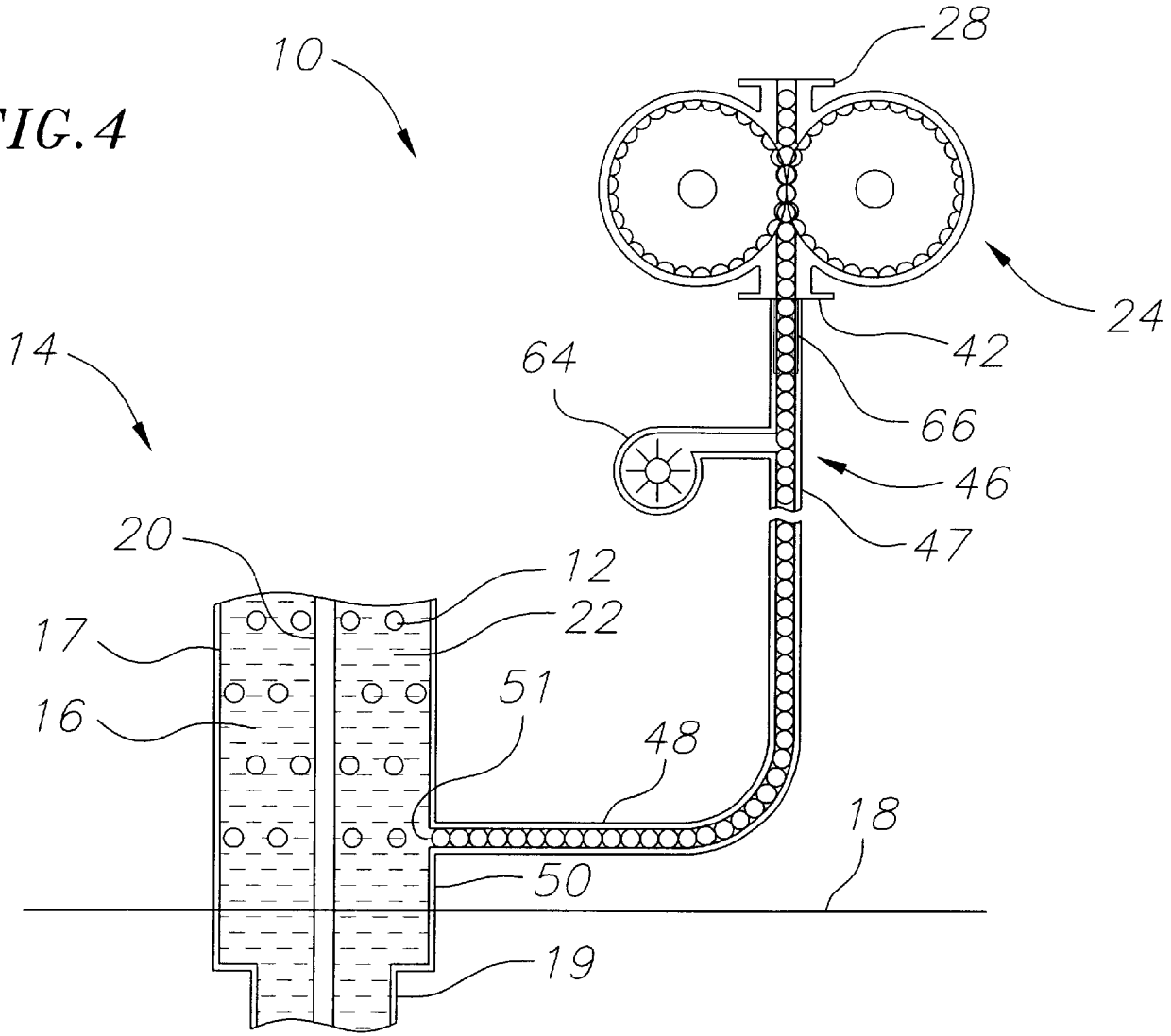
FIG. 4 is schematic of the pumping system of FIG. 1, with the addition of an air compressor pump.

As shown in FIGS. 3 and 4, the pumping system 10 may comprise in addition to that described above, a second pump. For example, in FIG. 3 the second pump is a fluid displacement pump 62 and in FIG. 4 the second pump is an air compressor 64.

Opposing the pumping forces that the sphere pump 24 applies to the buoyant spheres 12 are buoyancy forces that the drilling mud 22 at the opening 51 of the mud column 16 applies to the buoyant spheres 12. The second pump assists the sphere pump 24 in overcoming these buoyancy forces, allowing the buoyant spheres 12 to be conveyed from the sphere pump 24, through the conveyance pipe 46 and into the mud column 16.

As shown in FIG. 3, the fluid displacement pump 62 is connected to the conveyance pipe 46. The fluid displacement pump 62 assists the sphere pump 24 in overcoming the buoyancy forces, applied to the buoyant spheres 12 by the drilling mud 22, by injecting a fluid, for example water or sea water, into the conveyance pipe 46. The injected fluid applies a force to the buoyant spheres 12 to assist the buoyant spheres 12 in being conveyed from the sphere pump 24, through the conveyance pipe 46 and into the mud column 16. The fluid displacement pump 62 may be any one of a variety of conventional water pumps, among other.

In the depicted embodiment, the conveyance pipe 46 also comprises at least one seal. For instance, the conveyance pipe 46 may comprise a first seal 66 disposed in the proximal end 47 of the conveyance pipe 46 and a second seal 68 disposed in the distal end 48 of the conveyance pipe 46. The seals 66 and 68 may be attached to the inner diameter of the conveyance pipe 46 by any suitable means such as by molding, among others.

The seals 66 and 68 may be comprised of a material that is radially elastic, such as a rubber material that has an inner diameter that is smaller than the outer diameters of the buoyant spheres 12, such that a fluid tight seal is created around the outer diameter of a buoyant sphere 12 when the outer diameter of a buoyant sphere 12 is in contact with the seal 66 or 68. Preferably, each seal 66 and 68 is generally cylindrical and long enough, such that there is always at least one buoyant sphere 12 in the seal 66 and 68 to form a fluid tight seal. For example, the length of each seal 66 and 68 may be in the range of about 1 buoyant sphere diameter to about 3 buoyant sphere diameters.

In one embodiment, the fluid displacement pump 62 is connected to the proximal end 47 of the conveyance pipe 46, distal to the first seal 66. In this case, the first seal 66 prevents the fluid ejected from the fluid displacement pump 62 from traveling proximally past the first seal 66 and instead directs the ejected fluid in a distal direction towards the lower end 50 of the mud column 16. This allows the ejected fluid too apply a distally directed force to the buoyant spheres 12 and to travel with the buoyant spheres 12 distally down the conveyance pipe 46. In one embodiment, the conveyance pipe 46 comprises a screen section 70 in the distal end 48 of the conveyance pipe 46, proximal to the second seal 68. The screen section 70 has openings that are at least smaller than the diameter of the buoyant spheres 12, to allow the ejected fluid to pass through the screen section 70, while preventing the buoyant spheres 12 from passing through the screen section 70. The second seal 68 may be disposed in the distal end 48 of the conveyance pipe 46, distal to the screen section 70. The second seal 68 seals off the conveyance pipe 46 from the pressure of the drilling mud 22.

As shown in FIG. 4, the air compressor pump 64 is connected to the conveyance pipe 46. The air compressor pump 64 assists the sphere pump 24 in overcoming the buoyancy forces, applied to the buoyant spheres 12 by the drilling mud 22, by injecting compressed air into the conveyance pipe 46. The compressed air applies a force to the buoyant spheres 12 to assist the buoyant spheres 12 in being conveyed from the sphere pump 24, through the conveyance pipe 46 and into the mud column 16. The air compressor pump 64 may be any one of a variety of conventional air compressors. In the depicted embodiment, the conveyance pipe 46 comprises at least one seal, such as the first seal 66 described above. As above, the first seal 66 may be disposed in the proximal end 47 of the conveyance pipe 46.

In one embodiment, the air compressor pump 64 is connected to the proximal end 47 of the conveyance pipe 46, distal to the first seal 66. In this case, the first seal 66 prevents the compressed air ejected from the air compressor pump 64 from traveling proximally past the first seal 66 and instead directs the ejected compressed air in a distal direction towards the lower end 50 of the mud column 16. This allows the ejected compressed air to apply a distally directed force to the buoyant spheres 12 and to travel with the buoyant spheres 12 distally down the conveyance pipe 46.

The preceding description has been presented with references to presently preferred embodiments of the invention. Persons skilled in the art and technology to which this invention pertains will appreciate that alterations and changes in the described structures and methods of operation can be practiced without meaningfully departing from the principle, spirit and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A pumping system for injecting buoyant spheres into an oil or gas well comprising:

a feeder containing a plurality of buoyant spheres; and a sphere pump in proximity to the feeder, having first and second rotatable wheels, wherein the first wheel has a plurality of notches and the second wheel has a corresponding plurality of notches, such that during rotation of the wheels the first and second wheel notches temporarily combine to form a plurality of pockets, wherein each pocket receives and then ejects one of the plurality of buoyant spheres from the feeder during rotation of the first and second wheels.

2. The pumping system of claim 1, wherein the sphere pump is a positive displacement pump.

3. The pumping system of claim 1, wherein each of the plurality of first and second wheel notches are generally hemispherical.

4. The pumping system of claim 1, wherein each of the plurality of pockets is generally spherical, having a diameter substantially equal to the diameter of the buoyant spheres.

5. The pumping system of claim 1, wherein the first and second wheels contain matching gears which counter rotate the first and second wheels, such that the plurality of first and second wheel notches are aligned to form the plurality of pockets.

6. The pumping system of claim 1, further comprising a conveyance pipe having proximal and distal ends, wherein its proximal end is connected to an outlet of the sphere pump and its distal end is connected to a lower end of an oil or gas well.

7. The pumping system of claim 6, further comprising a fluid displacement pump in fluid communication with the conveyance pipe, and wherein the fluid displacement pump injects a fluid into the conveyance pipe.

8. The pumping system of claim 7, wherein the conveyance pipe has a first generally cylindrical seal at its proximal end and a second generally cylindrical seal at its distal end, wherein each seal is radially elastic and has a diameter which is smaller than the diameter of the buoyant spheres, such that a fluid tight seal is formed around each of the buoyant spheres during transit of each of the buoyant spheres through each seal.

9. The pumping system of claim 8, wherein the fluid displacement pump in fluid communication with the proximal end of the conveyance pipe, distal to the first seal and wherein the conveyance pipe contains a screen section having a plurality of openings, the screen section being disposed in the distal end of the conveyance pipe, proximal to the second seal.

10. The pumping system of claim 6, further comprising an air compressor pump in fluid communication with the conveyance pipe, and wherein the air compressor pump injects compressed air into the conveyance pipe.

11. The pumping system of claim 10, wherein the conveyance pipe has a radially elastic generally cylindrical seal at its proximal end, having a diameter which is smaller than the diameter of the buoyant spheres, such that a fluid tight seal is formed around each of the buoyant spheres during transit of each of the buoyant spheres through the seal.

12. The pumping system of claim 11, wherein the air compressor pump is in fluid communication with the proximal end of the conveyance pipe, distal to the radially elastic seal.

13. A pumping system for injecting buoyant spheres into an oil or gas well comprising:

a feeder containing a plurality of buoyant spheres; and a sphere pump in proximity to the feeder, having first and second rotatable wheels, wherein the first wheel has a plurality of notches and the second wheel has a corresponding plurality of notches, such that during rotation of the wheels the first and second wheel notches temporarily combine to form a plurality of pockets, wherein each pocket receives and then ejects one of the plurality of buoyant spheres from the feeder during rotation of the first and second wheels;

a conveyance pipe having proximal and distal ends, wherein its proximal end is connected to an outlet of the sphere pump and its distal end is connected to a lower end of an oil or gas well; and a second pump in fluid communication with the conveyance pipe.

14. The pumping system of claim 13, wherein the sphere pump is a positive displacement pump.

15. The pumping system of claim 13, wherein each of the plurality of first and second wheel notches are generally hemispherical and wherein each of the plurality of pockets is generally spherical, having a diameter substantially equal to the diameter of the buoyant spheres.

16. The pumping system of claim 13, wherein the second pump is a fluid displacement pump, which injects a fluid into the conveyance pipe.

17. The pumping system of claim 16, wherein the conveyance pipe has a first generally cylindrical seal at its proximal end and a second generally cylindrical seal at its distal end, wherein each seal is radially elastic and has a diameter which is smaller than the diameter of the buoyant spheres, such that a fluid tight seal is formed around each of the buoyant spheres during transit of each of the buoyant spheres through each seal.

18. The pumping system of claim 17, wherein the fluid displacement pump in fluid communication with the proximal end of the conveyance pipe, distal to the first seal and wherein the conveyance pipe contains a screen section having a plurality of openings, the screen section being disposed in the distal end of the conveyance pipe, proximal to the second seal.

19. The pumping system of claim 13, wherein the second pump is an air compressor pump, which injects compressed air into the conveyance pipe.

20. The pumping system of claim 19, wherein the conveyance pipe has a radially elastic generally cylindrical seal at its proximal end, having a diameter which is smaller than the diameter of the buoyant spheres, such that a fluid tight seal is formed around each of the buoyant spheres during transit of each of the buoyant spheres through the seal.

21. The pumping system of claim 20, wherein the air compressor pump is in fluid communication with the proximal end of the conveyance pipe, distal to the radially elastic seal.

22. A pumping system for injecting buoyant spheres into an oil or gas well comprising:

a feeder containing a plurality of buoyant spheres;

a positive displacement sphere pump in proximity to the feeder, having first and second counter rotating wheels, wherein the first wheel has a plurality of generally hemispherical notches and the second wheel has a corresponding plurality of generally hemispherical notches, such that during rotation of the wheels, the first and second wheel notches temporarily combine to form a plurality of generally spherical pockets, wherein each pocket receives and then ejects one of the plurality of buoyant spheres from the feeder during rotation of the first and second wheels;

a conveyance pipe having proximal and distal ends, wherein its proximal end is connected to an outlet of the sphere pump and its distal end is connected to a lower end of an oil or gas well; and a second pump in fluid communication with the conveyance pipe.

23. The pumping system of claim 22, wherein each of the plurality of pockets has a diameter substantially equal to the diameter of the buoyant spheres.

24. The pumping system of claim 22, wherein the second pump is a fluid displacement pump, which injects a fluid into the conveyance pipe.

25. The pumping system of claim 24, wherein the conveyance pipe has a first generally cylindrical seal at its proximal end and a second generally cylindrical seal at its distal end, wherein each seal is radially elastic and has a diameter which is smaller than the diameter of the buoyant spheres, such that a fluid tight seal is formed around each of the buoyant spheres during transit of each of the buoyant spheres through each seal.

26. The pumping system of claim 25, wherein the fluid displacement pump is in fluid communication with the proximal end of the conveyance pipe, distal to the first seal and wherein the conveyance pipe contains a screen section having a plurality of openings, the screen section being disposed in the distal end of the conveyance pipe, proximal to the second seal.

27. The pumping system of claim 22, wherein the second pump is an air compressor pump, which injects compressed air into the conveyance pipe.

28. The pumping system of claim 27, wherein the conveyance pipe has a radially elastic generally cylindrical seal at its proximal end, having a diameter which is smaller than the diameter of the buoyant spheres, such that a fluid tight seal is formed around each of the buoyant spheres during transit of each of the buoyant spheres through the seal.

29. The pumping system of claim 28, wherein the air compressor pump is in fluid communication with the proximal end of the conveyance pipe, distal to the radially elastic seal.

30. A method of reducing a density of a drilling fluid in an oil or gas well comprising:

conveying a plurality of buoyant spheres to a feeder, the sphere pump having first and second rotatable wheels;

providing a sphere pump in proximity to the feeder, the sphere pump having first and second rotatable wheels which apply a first force to the plurality of buoyant spheres, wherein the sphere pump is connected to a proximal end of a conveyance pipe and wherein a distal end of the conveyance pipe is connected to a lower end of a portion of an oil or gas well that is adjacent to the drilling fluid;

providing a second pump in fluid communication with the proximal end of the conveyance pipe, which applies a second force to the plurality of buoyant spheres, wherein the first and second forces cause the buoyant spheres to be injected into the drilling fluid to decrease the density of the drilling fluid.

31. The method of claim 30, wherein the second pump injects a fluid into the conveyance pipe, such that the fluid applies the second force to the buoyant spheres.

32. The method of claim 31, wherein the conveyance pipe comprises a first generally cylindrical seal at its proximal end and a second generally cylindrical seal at its distal end, wherein each seal is radially elastic and has a diameter which is smaller than the diameter of the buoyant spheres, such that a fluid tight seal is formed around each of the buoyant spheres during transit of each of the buoyant spheres through each seal.

33. The method of claim 30, wherein the second pump injects compressed air into the conveyance pipe, such that the compressed air applies the second force to the buoyant spheres.

34. The method of claim 33, wherein the conveyance pipe has a radially elastic generally cylindrical seal at its proximal end, having a diameter which is smaller than the diameter of the buoyant spheres, such that a fluid tight seal is formed around each of the buoyant spheres during transit of each of the buoyant spheres through the seal.

35. The method of claim 30, wherein the first wheel has a plurality of notches and the second wheel has a corresponding plurality of notches, such that during rotation of the wheels the first and second wheel notches temporarily combine to form a plurality of pockets, such that each pocket applies the first force to the buoyant spheres.

36. The method of claim 35, wherein each of the plurality of first and second wheel notches are generally hemispherical and wherein each of the plurality of pockets is generally spherical, having a diameter substantially equal to the diameter of the buoyant spheres.

* * * * *

UNITED STATES PATENT AND TRADEMARK OFFICE

CERTIFICATE OF CORRECTION

PATENT NO. : 6,588,501 B1
DATED : July 8, 2003
INVENTOR(S) : George Boyadjieff

It is certified that error appears in the above-identified patent and that said Letters Patent is hereby corrected as shown below:

Column 9,
Line 34, after "feeder" delete the following from Claim 30: ", the sphere pump having first and second rotatable wheels"

Signed and Sealed this

Twenty-eighth Day of September, 2004

JON W. DUDAS
*Director of the United States Patent and Trademark Office*